US005413077A

United States Patent [19]

Hornby et al.

[11] Patent Number: 5,413,077

[45] Date of Patent: May 9, 1995

[54] NON-RETURN FUEL SYSTEM WITH FUEL PRESSURE VACUUM RESPONSE

[75] Inventors: Michael J. Hornby, Williamsburg; Barry S. Robinson, Newport News, both of Va.

[73] Assignee: Siemens Automotive L.P., Auburn Hills, Mich.

[21] Appl. No.: 239,661

[22] Filed: May 9, 1994

[51] Int. Cl.[6] ..... F02M 69/16

[52] U.S. Cl. ..... 123/457; 123/460; 123/463

[58] Field of Search ..... 123/456, 457, 460, 463, 123/497

[56] References Cited

U.S. PATENT DOCUMENTS

| | | | |
|---|---|---|---|
| 4,539,960 | 9/1985 | Cowles | 123/463 |
| 5,148,792 | 9/1992 | Tuckey | 123/497 |
| 5,237,975 | 8/1993 | Betki et al. | 123/497 |
| 5,265,644 | 11/1993 | Tuckey | 123/463 |
| 5,339,785 | 8/1994 | Wilksch | 123/457 |

*Primary Examiner*—Henry C. Yuen

*Assistant Examiner*—Thomas N. Moulis

*Attorney, Agent, or Firm*—Russel C. Wells; George L. Boller

[57] ABSTRACT

A fuel pressure regulator valve for a fuel rail requires only a single conduit between the tank-mounted fuel pump and the fuel rail, thereby eliminating the need for a separate, and additional, return conduit for returning excess fuel to the tank. It does this by a spring-biased check valve in the inlet to the fuel chamber of the regulator. The check is biased to prevent flow from the pump into the fuel chamber of the regulator, but when the pressure in the rail drops below a certain level, a post on the diaphragm that separates the fuel chamber of the regulator from a control chamber of the regulator, unseats a spherical valve element in the check valve to allow pumped fuel to enter the fuel chamber of the regulator and pass into the fuel rail to the fuel injectors. When the pressure has built up beyond a certain pressure, the sphere again closes. Excess pressure is relieved by the pressure acting on the sphere causing the sphere to unseat, thereby allowing the excess fuel to pass out through the pressure regulator inlet.

8 Claims, 2 Drawing Sheets

NON-RETURN FUEL SYSTEM WITH FUEL PRESSURE VACUUM RESPONSE

FIELD OF THE INVENTION

This invention relates generally to a fuel system of an internal combustion engine that powers an automotive vehicle, and more specifically to a novel fuel pressure regulator for use in a fuel rail assembly that contains electrically operated fuel injectors. The inventive fuel pressure regulator is adapted for a non-return (dead-headed) fuel rail assembly that does not require a separate return conduit for returning excess fuel from the fuel rail assembly to the fuel tank.

BACKGROUND AND SUMMARY OF THE INVENTION

The present inventors'commonly assigned co-pending patent application Ser. No. 08/092,320 filed 14 Jul. 1993 discloses a fuel pressure regulator that is disposed inside a fuel tank. Although that pressure regulator spills excess fuel back to the fuel supply inside the tank, that sort of a system avoids the use of a separate return conduit from the engine back to the tank since the pressure regulator is inside the tank rather than on the fuel rail assembly. Eliminating the return conduit can often provide meaningful cost and space savings, but when doing so places the fuel pressure regulator more remote from the fuel rail assembly, it may be necessary to invoke measures for assuring that the remoteness does not impose undesired consequences on the performance of the fuel rail assembly. Moreover, a tank-mounted pressure regulator is typically not conveniently disposed for direct intake manifold vacuum compensation, and even if engine manifold vacuum were to be conveyed to it, a vacuum conduit from the engine to the fuel tank would be needed, thereby at least to some extent defeating the purpose of eliminating the fuel return conduit.

The present invention relates to a new and unique fuel pressure regulator that both enables the fuel pressure regulator to be mounted on the fuel rail assembly, where it can be close to the fuel injectors, and avoids the use of a separate fuel return conduit from the fuel rail assembly to the tank. Moreover, the inventive fuel pressure regulator retains intake manifold vacuum compensation by means of a control chamber to which intake manifold vacuum Can be conveniently conveyed through a short conduit from a nearby vacuum port on the engine's induction system.

Further features and advantages will be seen from the following detailed description of a presently preferred embodiment. Claims and drawings accompany the description, and the drawings and description disclose the best mode contemplated at this time for carrying out the invention.

DESCRIPTION OF THE PREFERRED EMBODIMENT

Figure 1:
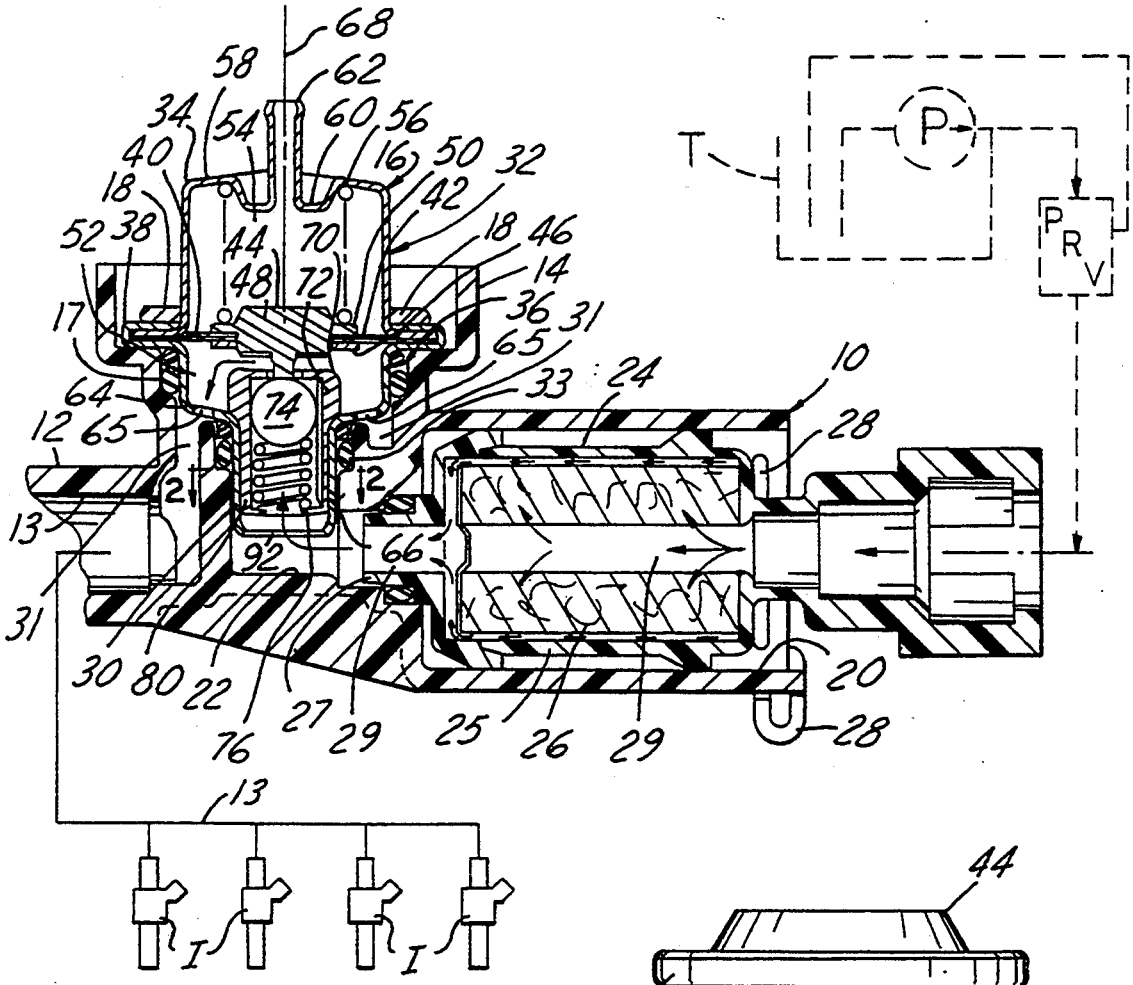
FIG. 1 is a longitudinal cross-sectional view through an inlet end portion of a fuel rail assembly that contains a fuel pressure regulator embodying principles of the present invention.
Figure 7:
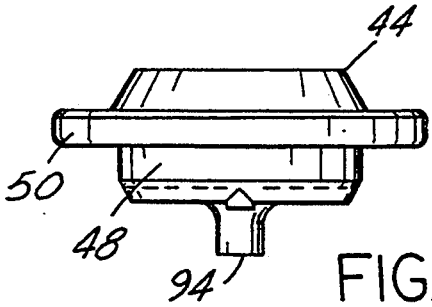
FIG. 7 is an enlarged elevational view of one of the parts of FIG. 1 shown by itself, looking in the same direction as the view of FIG. 1.
Figure 2:
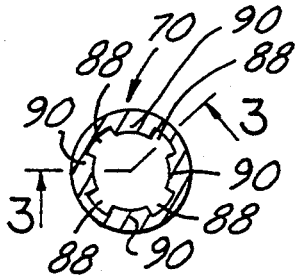
FIG. 2 is a full transverse cross sectional view, on an enlarged scale, in the direction of arrows 2—2 in FIG. 1, but with certain parts being omitted for illustrative purposes only.
Figure 8:
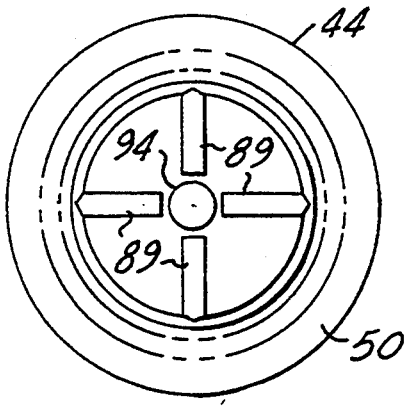
FIG. 8 is a bottom end view of FIG. 7.

FIG. 1 shows a fuel rail assembly 10 comprising a fuel rail 12 that has a main fuel passageway 13 that serves fuel to a number of electrically operated fuel injectors I at various locations along its length. Fuel injectors I are not shown in detail and are represented only schematically. Fuel rail 12 may be constructed in any conventional way, from metal parts assembled together, or from molded composite material as shown by the example in the drawings. Fuel rail 12 includes a first integral cylindrical socket 14 whose axis is transverse to the length of the fuel rail and within which a fuel pressure regulator 16 embodying principles of the invention is coaxially disposed in a fluid-tight manner with the aid of an O-ring sealing means 17. Socket 14 is shaped to receive fuel pressure regulator 16 and to provide for the separable retention of the fuel pressure regulator therein using a removable forked retention clip 18.

At its fuel inlet end, fuel rail 12 comprises a second integral cylindrical socket 20 that is coaxial with the length of the fuel rail. Socket 20 is open at one axial end and has two internal shoulders at the opposite axial end for successively reducing the I.D. of the socket at that latter location, but leaving that end open for communication with a short passage 22 that leads to fuel pressure regulator 16. A combination inlet connector fitting-filter cartridge and housing assembly 24 is disposed in association with socket 20 for conveying fuel from a fuel supply conduit to passage 22 and filtering the fuel in the process. The filter cartridge and housing portion of assembly 24 is disposed within socket 20 while the assembly's inlet connector fitting portion is disposed external to the socket where it is available for connection with a mating connector (not shown) on the fuel supply conduit that delivers pressurized fuel to the fuel rail assembly from a pump P mounted on a remotely located fuel tank T. One of the purposes of fuel pressure regulator 16 is of course to maintain in main fuel passage 13 a fairly well controlled fuel pressure rather than to allow it to directly track the pump pressure. The complete fuel system preferably further includes a pressure relief valve PRV disposed between pump P and the fuel rail assembly. This PRV is set to open when the pressure between the outlet of pump P and the inlet of fuel pressure regulator 16 exceeds a pressure that is a certain amount higher than the regulation pressure that is provided by fuel pressure regulator 16 to main fuel passage 13. For example, if the regulation pressure is say 50 psi, PRV may be set to open and return fuel to the tank at 60 psi.

Assembly 24 comprises a cylindrical shaped housing 25 within which a tubular filter cartridge 26 is disposed. The housing has a neck 27 that fits complementary to the interior end of socket 20 in fluid tight fashion. The cartridge housing wall is imperforate except for the entrance where connector fitting portion joins it and for the exit formed by neck 27. After the cartridge housing portion has been fully inserted into socket 20, a forked retention clip 28, that is similar to clip 18, is engaged with the socket wall proximate the socket's open end to hold assembly 24 in place by engaging an end wall of the cartridge housing at locations that are to either side of where the connector fitting portion integrally joins with that end wall. The retention clip has a feature that causes it to be self-retaining on the edge of the socket when fully installed. Details of retention clip 28, and how it is associated with the socket end, are like the embodiment shown in the commonly assigned co-pending patent application of one of the present inventors entitled "Fuel Pressure Regulator/Fuel Filter Module" Ser. No. 08/226,912; Filed 13, Apr. 1994, whose disclosure is incorporated herein by reference for the purpose of presenting detail of the retention clip and its functional association with the socket and the device that it retains in the socket.

Filter cartridge 26 is disposed coaxially within cartridge housing 25 such that a flow path 29 is defined through assembly 24, as indicated by the arrows extending from the fuel inlet to passage 22. The filter cartridge will filter certain foreign material from the entering fuel so that such material does not reach either the fuel pressure regulator or the fuel injectors.

The bottom of socket 14 has a hole 30 which intersects passage 22. The socket further comprises an annular well 31 that is disposed in surrounding relation to, but sealed off from, hole 30 by an O-ring sealing means 33 that is disposed in hole 30 to seal between the wall of the hole and a tubular portion of the fuel pressure regulator, as shown and will be explained in more detail later on. Well 31 in turn leads to main fuel passage 13.

Fuel pressure regulator 16 comprises a generally cylindrical housing 32 composed of two drawn metal cups 34, 36 that are joined and sealed together at confronting rims to form a flange 38 that extends around the outside of housing 32 approximately midway between axially opposite ends of housing 32. The sealed joint that comprises flange 38 also holds the radially outer margin of a movable wall 40 that is composed of an annular outer part 42 and a solid central part 44. The latter is held sealed against the radially inner margin of part 42 by means of a ring 46. Central part 44 comprises a generally cylindrical body 48 bounded by a radially outwardly directed flange 50. Flange 50 is disposed against a radially inner margin on one side of part 42 while ring 46 is disposed on the opposite side so that it sandwiches the inner margin of part 42 against flange 50 in a sealed manner. A portion of body 48 of part 44 projects through the open center of part 42 enabling ring 46 to be secured to body 48 in any suitable manner so that the parts 44, 46 and 42 are thereby united for movement in unison while the radially outer margin of part 42 is held static at flange 38.

Movable wall 40 divides housing 32 into a fuel chamber 52 and a control chamber 54. Control chamber 54 contains a helical coil compression spring 56 disposed between an axial end wall 58 of cup 34 and flange 50, the end wall 58 being shaped to provide a suitable seat 60 for one end of spring 56 and the diameter of body 48 being sufficiently sized in relation to flange 50 to form a spring seat for the other end of the spring. Spring 56 functions to resiliently urge movable wall 40 in a direction that tends to increase the volume of chamber 54 at the expense of concurrently decreasing that of fuel chamber 52.

At the center of spring seat 60, end wall 58 is shaped to form a nipple 62 that projects outwardly of housing 32. Cup 36 is shaped to form a shoulder 64 leading to a cylindrical neck 66 that extends away from housing 32 in the opposite direction from nipple 62. Nipple 62 and neck 66 are mutually co-axial with each other and coincident with a main longitudinal axis 68 of housing 32. Shoulder 64 contains several holes 65 distributed at particular locations around its circumference to provide fluid communication between fuel chamber 52 and well 31.

A check valve assembly 70, shown in more detail in FIGS. 2 through 6, is mounted on cup 36 co-axial with axis 68 and comprises a generally tubular body 72, a sphere 74 and a helical coil compression spring 76. The O.D. of body 72 comprises a shoulder 78 creating for body 72 a neck 80 having at its distal end an inwardly directed circular flange 79 circular opening 77. Neck 80 is fit inside neck 66 in a fluid-tight manner, with shoulder 78 seating on the radially inner margin of shoulder 64, leaving the remainder, and slightly larger diameter portion, of body 72 disposed within fuel chamber 52.

The I.D. of body 72 comprises a through-passage 81 that may be considered to have three distinctive sections 82, 84, 86 in axial succession. The first section 82 has a series of axial grooves 88 (FIG. 2) distributed circumferentially and running parallel to axis 68. Thus, the I.D. of section 82 may be considered to comprise a series of circumferentially distributed ridges 90 of section 82. The diameter of sphere 74 is just small enough to allow it to move axially within section 82, being guided in the process by the nominal I.D. defined by ridges 90 such that any radial play is kept to a minimum. The second section 84 is essentially a shoulder whose radially inner edge forms a circular seat 85 for sphere 74. Section 86 is simply a small circular hole extending from seat 85 through the proximate axial end wall of body 72.

Figure 3:
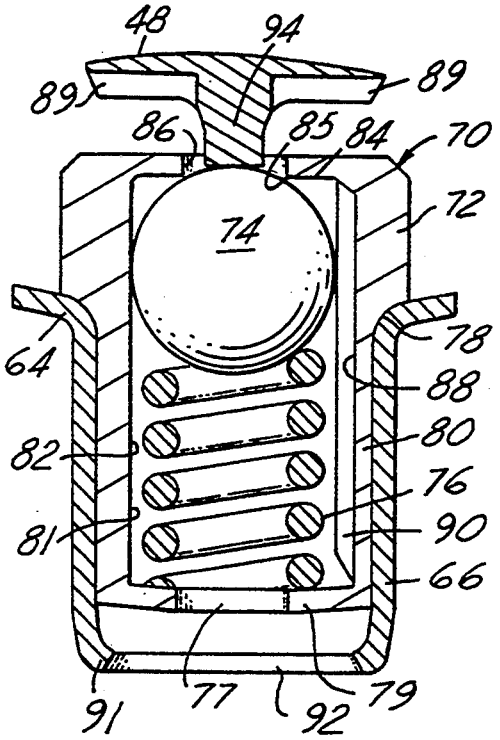
FIG. 3 is an enlarged view of a portion of FIG. 1, generally as taken in the direction of arrows 3—3 in FIG. 2.
Figure 5:
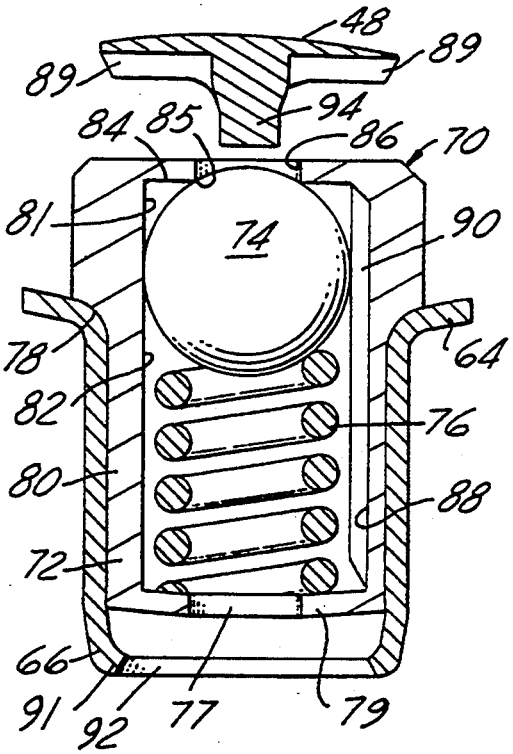
FIG. 5 is a view similar to FIG. 3, but showing another different operative condition.
Figure 4:
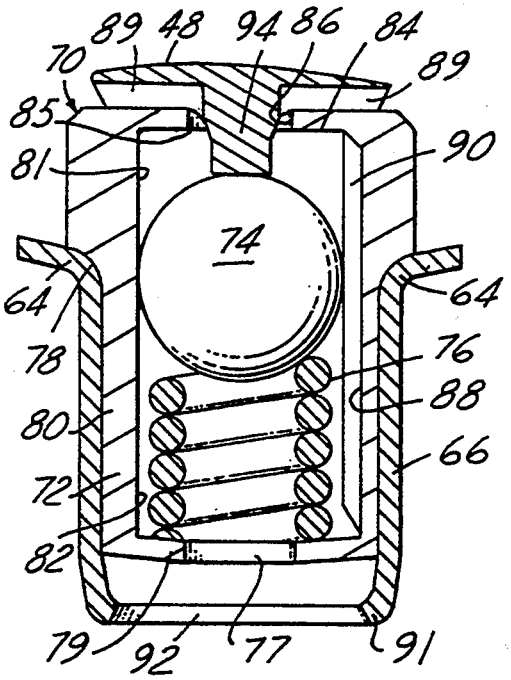
FIG. 4 is a view similar to FIG. 3, but showing one different operative condition.
Figure 6:
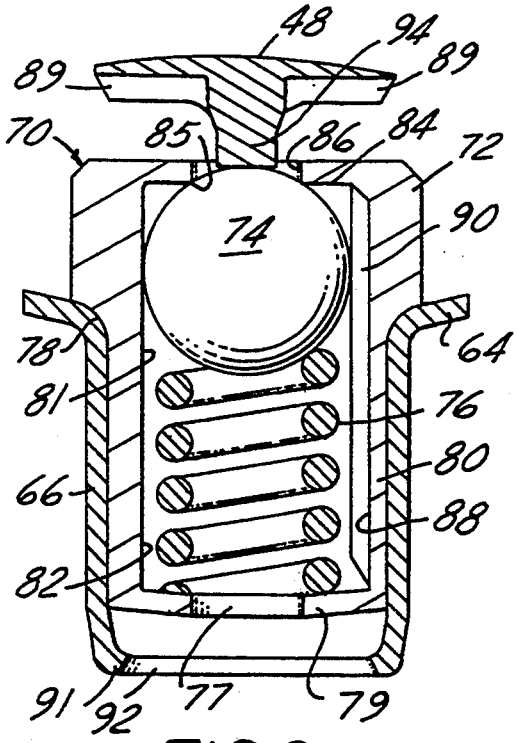
FIG. 6 is a view similar to FIG. 3, but showing a still another different operative condition.

Spring 76 is disposed between flange 79 and sphere 74 for resiliently urging sphere 74 toward seating engagement with valve seat 85. FIGS. 1 and 3 show sphere slightly unseated from seat 85. Sphere 74 acts as a valve element that is selectively positioned axially within through-passage 81 over a range of positions extending from a seated position on seat 85 where it blocks flow through passage 81 to unseated positions representing progressively increasing degrees of unseating the farther it is progressively displaced from seat 85 against spring 76. FIG. 4 shows a position of maximum unseating while both FIGS. 5 and 6 show the sphere seated.

The distal end of neck 66 comprises a short radially inwardly directed flange 91 circumscribing a circular inlet opening 92 for fuel pressure regulator 16 to be in fluid communication with the fuel in passage 22. Opening 92 provides for the fuel to enter check valve assembly 70 through opening 77.

A short post 94 depends centrally from body 48 in alignment with hole 86 and is adapted to act on sphere 74 depending on the position of movable wall 40 which is in turn dependent of the forces acting on it. When pressures in chambers 52 and 54 are equal, spring 56 will force movable wall 40 downwardly, causing the tip end of post 94 to pass through opening 86 and unseat sphere 74, pushing the sphere downwardly and compressing spring 76 in the process to a position like that shown in FIG. 4. As the force exerted by post 94 on sphere 74 decreases from that represented by FIG. 4, the sphere moves toward seat 85. When that force has diminished to a certain magnitude, the sphere will seat on the seat as in FIG. 6, and should that force diminish even further, post 94 will lift off sphere 74 as in FIG. 5. Whenever sphere 74 is unseated from seat 85, passage 81 is open, allowing fuel to pass through check valve assembly 70, fuel chamber 52, holes 65, well 31, and main fuel passage 13 to fuel injectors I. This will be true even if body 48 of part 44 bottoms out on the end wall of body 72 that contains opening 86, as is portrayed by FIG. 4, because the bottom of body 48 contains several radial channels 89 that maintain communication of opening 86 to fuel chamber 52.

The typical pressure regulating action will strive to position sphere 74 in relation to seat 85 such that just the right amount of fuel flows through the pressure regulator to satisfy the demands of the fuel injectors. As demand increases, the degree of opening will be greater; as it slackens, the degree of opening becomes less. But under all such demand conditions the fuel pressure regulator maintains a desired pressure in main fuel passage 13. Because of the effect of communicating control chamber 54 to intake manifold vacuum, typical changes in engine operation that create change in intake manifold vacuum are compensated so that a desired pressure is maintained across the fuel injectors in spite of variations in intake manifold vacuum.

A separate return conduit for returning excess fuel to the tank is not required because of the novel construction of fuel pressure regulator 16. If, whenever sphere 74 is seated on seat 85 closing flow through the fuel pressure regulator, the pressure in main fuel passage 13 and fuel chamber 52 rises beyond a certain pressure established by the design of check valve assembly 70, the pressure in fuel chamber 52 acting on that portion of sphere 74 exposed to fuel chamber 52 will displace the sphere just enough to crack the pressure regulator open so that the excess pressure in passage 13 and fuel chamber 52 will be relieved. This may occur when the engine is off and elevated temperatures are present. Excess fuel will pass back through hole 30, passage 22, and assembly 24. Although PRV will limit pressure between the fuel rail and pump P to its setting, such as the 60 psi mentioned earlier, pressures in the fuel rail well above the PRV setting that cause the fuel pressure regulator to crack open may not necessarily be relieved to the PRV setting before the fuel pressure regulator re-closes by re-seating the sphere 74 on seat 85.

As those who are familiar with fuel pressure regulators can appreciate, the fuel pressure regulating action within the regulator is intended to occur with minimum fluctuations so that fuel pressure is maintained across the fuel injectors over the typical range of operating conditions to which the engine is subjected. The actual design of any particular fuel pressure regulator will depend upon many factors such as the regulation pressure, the number of fuel injectors, etc., and conventional engineering calculations can be used to establish the sizes and characteristics of various parts of any given fuel pressure regulator embodying principles of the invention.

Check valve assembly 70 may be considered as a normally closed check valve means having a first port that is exposed to fuel in fuel chamber 52 and a second port that is exposed to pump pressure. Sphere 74 is biased by spring 76 to allow flow in a favored direction of flow from said first port to said second port (i.e., in the direction from opening 86 to opening 77) and to disallow flow in the opposite (i.e., disfavored) direction. Sphere 74 is disposed to open and allow flow from fuel chamber 52 through passage 81 in the favored direction whenever the fuel pressure in fuel chamber 52 exceeds that at the inlet to the pressure regulator by a predetermined difference. Additionally however, operation of post 94 by movable wall 40 will force sphere 74 to unseat from seat 85 to allow flow in the disfavored direction in response to the fuel pressure in fuel chamber 52 falling below a desired fuel regulation pressure for the fuel injectors.

While a presently preferred embodiment has been illustrated and described, principles are applicable to any embodiment falling with the scope of the following claims.

What is claimed is:

1. A fuel pressure regulator assembly comprising a housing divided by a movable wall into a fuel chamber and a control chamber, said housing comprising a fuel inlet port leading to said fuel chamber and adapted to be fluid-coupled to a fuel pump for delivering pressurized fuel to said fuel chamber, said housing comprising a fuel outlet port for delivering pressure-regulated fuel to a utilization means that uses pressure-regulated fuel, normally closed check valve means having a first port that is exposed to fuel in said fuel chamber and a second port that is adapted to be exposed to pressure applied to it from such a fuel pump, said check valve means comprising means biased to allow flow in a favored direction of flow from said first port to said second port and to disallow flow in a disfavored direction from said second port to said first port, said biased means of said check valve means being disposed for operation that allows flow from said fuel chamber through said check valve means in the favored direction toward such a fuel pump in response to the fuel pressure in said fuel chamber exceeding that applied to said second port by a predetermined difference, and means operated by said movable wall to force said biased means of said check valve means to open said check valve means to allow flow from such a fuel pump through said check valve means in the disfavored direction and into said fuel chamber in response to the fuel pressure in said fuel chamber falling below a desired fuel regulation pressure for such utilization means.

2. A fuel pressure regulator as set forth in claim 1 in which said biased means of said check valve means comprises a valve element that is resiliently biased by spring means, and said means operated by said movable wall comprises a post that is disposed to open said check valve means by unseating said valve element from a valve seat on a body of said check valve means.

3. A fuel pressure regulator as set forth in claim 2 in which said valve element is a sphere, said body of said check valve means comprises a through-passage containing said valve seat and within which said sphere is disposed, said post extending into said through-passage to engage said sphere for unseating same from said valve seat.

4. A fuel pressure regulator as set forth in claim 3 in which said fuel inlet comprises a neck within which a neck of said body is disposed, and said valve seat is disposed between said neck of said body and said fuel chamber.

5. A fuel injection system comprising a fuel rail assembly for mounting on an internal combustion engine comprising electrically operated fuel injectors and fuel pressure regulator means for regulating the pressure of fuel supplied to said fuel injectors, a fuel tank containing a pump for pumping pressurized fuel to said fuel rail assembly, said fuel pressure regulator means comprising a fuel chamber and a control chamber divided by a movable wall, said fuel rail assembly comprising first passage means supplying to said fuel chamber fuel that has been pumped from said pump and second passage means supplying fuel from said fuel chamber to said fuel injectors, normally closed check valve means having a first port that is exposed to fuel in said fuel chamber and a second port that is adapted to be exposed to pressure applied to it from said fuel pump, said check valve means comprising means biased to allow flow in a favored direction of flow from said first port to said second port and to disallow flow in a disfavored direction from said second port to said first port, said biased means of said check valve means being disposed for operation that allows flow from said fuel chamber through said check valve means in the favored direction toward said fuel pump in response to the fuel pressure in said fuel chamber exceeding that applied to said second port by a predetermined difference, and means operated by said movable wall to force said biased means of said check valve means to open said check valve means to allow flow from said fuel pump through said check valve means in the disfavored direction and into said fuel chamber in response to the fuel pressure in said fuel chamber falling below a desired fuel regulation pressure for said fuel injectors.

6. A fuel injection system as set forth in claim 5 in which said check valve means is disposed in an inlet tube of a housing of said fuel pressure regulator means that contains said fuel chamber and said control chamber divided by said movable wall.

7. A fuel injection system as set forth in claim 5 including a pressure relief valve between said second port of said check valve means and said pump for relieving pressure between said pump and said second port of said check valve means above a predetermined relief pressure that is greater than the desired fuel regulation pressure for the fuel injectors.

8. In a fuel pressure regulator assembly, the combination comprising a housing having a movable wall bounding a portion of a fuel pressure regulating chamber, said housing comprising a fuel inlet port leading to said chamber and adapted to be fluid-coupled to a fuel pump for delivering pressurized fuel to said chamber, said housing comprising a fuel outlet port for delivering pressure-regulated fuel to a utilization means that uses pressure-regulated fuel, normally closed check valve means having a first port that is exposed to fuel in said chamber and a second port that is adapted to be exposed to pressure applied to it from such a fuel pump, said check valve means comprising means biased to allow flow in a favored direction of flow from said first port to said second port and to disallow flow in a disfavored direction from said second port to said first port, said biased means of said check valve means being disposed for operation that allows flow from said chamber through said check valve means in the favored direction toward such a fuel pump in response to the fuel pressure in said chamber exceeding that applied to said second port by a predetermined amount, and means operated by said movable wall to force said biased means of said check valve means to open said check valve means to allow flow from such a fuel pump through said check valve means in the disfavored direction and into said chamber in response to the fuel pressure in said chamber falling below a predetermined fuel regulation pressure for such a utilization means.

* * * * *